US008056550B2

(12) United States Patent
Godi

(10) Patent No.: US 8,056,550 B2
(45) Date of Patent: Nov. 15, 2011

(54) BLOCK-CUTTING GANGSAW FOR CUTTING GRANITE OR OTHER HARD MATERIALS, AND CORRESPONDING CUTTING METHOD

(75) Inventor: Alessandro Godi, Verona (IT)

(73) Assignee: Quarella S.p.A., Verona (IT)

( * ) Notice: Subject to any disclaimer, the term of this patent is extended or adjusted under 35 U.S.C. 154(b) by 361 days.

(21) Appl. No.: 12/376,477

(22) PCT Filed: Aug. 6, 2007

(86) PCT No.: PCT/IB2007/002251

§ 371 (c)(1),
(2), (4) Date: Feb. 5, 2009

(87) PCT Pub. No.: WO2008/017918

PCT Pub. Date: Feb. 14, 2008

(65) Prior Publication Data

US 2010/0180879 A1 Jul. 22, 2010

(30) Foreign Application Priority Data

Aug. 11, 2006 (IT) ..... MI2006A1618

(51) Int. Cl.
*B28D 1/06* (2006.01)

(52) U.S. Cl. ..... 125/16.01; 125/17

(58) Field of Classification Search ..... 125/16.01, 125/16.03, 16.04, 17

See application file for complete search history.

(56) References Cited

U.S. PATENT DOCUMENTS

| | | | | |
|---|---|---|---|---|
| 173,709 | A * | 2/1876 | Young et al. | 125/16.01 |
| 337,661 | A | 3/1886 | Campbell | |
| 364,458 | A | 6/1887 | Young | |
| 1,347,365 | A * | 7/1920 | Fletcher | 125/1 |
| 1,921,697 | A * | 8/1933 | Owens et al. | 125/19 |
| 2,522,999 | A * | 9/1950 | Dahlstrom | 125/19 |
| 4,993,299 | A * | 2/1991 | Hallez et al. | 83/751 |
| 5,150,641 | A * | 9/1992 | Werner | 83/647 |
| 2003/0127086 | A1 * | 7/2003 | Brauninger et al. | 125/16.01 |
| 2003/0145701 | A1 | 8/2003 | Ogden | |

FOREIGN PATENT DOCUMENTS

| | | |
|---|---|---|
| EP | 0334831 | 9/1989 |
| WO | 99/42267 | 8/1999 |

OTHER PUBLICATIONS

PCT International Search Report for PCT/IB2007/002251 filed on Aug. 6, 2007 in the name of Quarella S.P.A.
PCT Written Opinion for PCT/IB2007/002251 filed on Aug. 6, 2007 in the name of Quarella S.P.A.

* cited by examiner

*Primary Examiner* — Robert Rose
(74) *Attorney, Agent, or Firm* — Steinfl & Bruno LLP

(57) ABSTRACT

Block-cutting gangsaw with vertical frame for cutting granite or other hard materials, comprising a blade-holding frame (19) that is supported with the possibility of reciprocating movement on an independent oscillating frame (40) which imparts the oscillating movement to it, so that each blade (20) of blade-holding frame (19) is always in contact with work-piece (18), and the contact area moves along a convex, curved trajectory.

8 Claims, 5 Drawing Sheets

BLOCK-CUTTING GANGSAW FOR CUTTING GRANITE OR OTHER HARD MATERIALS, AND CORRESPONDING CUTTING METHOD

CROSS REFERENCE TO RELATED APPLICATIONS

The present application is the US national stage of International Application PCT/IB2007/002251 filed on Aug. 6, 2007 which, in turn, claims priority to Italian Application MI2006A001618, filed on Aug. 11, 2006.

This invention relates to a block-cutting gangsaw for cutting granite or other hard materials which cuts by combining the reciprocating motion of the frame with an oscillating movement of the frame guides, so that the area of contact between the blade and the block moves along an arc with an approximately circular shape. The invention also relates to a corresponding cutting method.

Marble-cutting machines exist in which the approximately linear vertical reciprocating motion of the frame is combined with the horizontal advance movement of the block. This combination of movements between the frame and the marble block produces a fairly uniform, though rather low specific pressure, and this loading condition gives the blades a degree of convexity in relation to the block, which is partly compensated by pre-loading the blades with tie-bars fitted eccentrically to the blade.

When cutting granite, the specific contact pressure with the blade must be much higher than is sufficient for marble or other materials. The contact area between the blade and the granite must consequently be limited, but this prevents a linear movement of the blade-holding frame from being maintained.

If a linear vertical movement were to be maintained when the granite is cut, and a sufficiently high block advance speed maintained, progressive curvature of the blade would be caused, as the load would be concentrated on the upper and lower ends of the block, and this would soon lead to breakage of the blade.

EP-0334831 describes a sawing machine with a vertical saw frame, wherein the blade-holding frame performs a reciprocating movement and is articulated at the four corners to blocks engaged with corresponding slides that limit the travel of the gangsaw. The slides are mounted slidingly in relation to the frame of the gangsaw, each along corresponding pairs of cross-guides, to define a trajectory perpendicular to the guiding direction of the slides. The lower and upper slides move in opposite directions, causing the blade-holding frame to oscillate around a horizontal median axis.

The result is that the cutting blades determine an ovoidal cutting trajectory with a progressive curvature radius.

The main purpose of said patent is to cause half the blade inserts to operate during the upward movement and the other half during the downward movement, unlike earlier solutions, wherein the whole blade operated in a single direction.

WO 99/42267 describes a cutting machine with a horizontal frame and illustrates different cutting methods, with an angular contour or an arched contour. When cutting with an arched contour, the blades are lifted from the block for part of the operating cycle, about halfway through the complete cycle.

Structurally, the machine is fitted with a flywheel, with a connecting rod and crank mechanism for the reciprocating linear motion of the blade-holding frame and a cam or crank system for the oscillating movement of a guide frame supporting the blade-holding frame. The cams can be variously phased in relation to the flywheel, and their (opposite) rotation speeds can be varied in relation to that of the flywheel, depending on the desired contact trajectory with the block to be cut.

Each cam always rotates in the same direction, and transmits a longitudinal as well as an oscillating movement to the guide frame.

The purpose of the invention is to offer a new gangsaw movement system which increases the contact pressure between the blade and the granite, or the workpiece in general if the material is not granite, by limiting the length of the contact area between blade and material, while the overall strength is maintained at values that cause acceptable loads and deformations on the blade.

A further purpose of the invention is to offer a gangsaw movement system that continuously and periodically moves the contact area between the blade and the workpiece along the whole height of the block.

A further purpose of the invention is to offer a gangsaw wherein the wear on the blade is distributed along its length.

These purposes, and others which will become clear from the description that follows, are achieved by the gangsaw and cutting method according to the invention, which present the characteristics described in independent claims 1 and 12 respectively.

Advantageous embodiments of the invention are described in the dependent claims.

Substantially, the gangsaw according to the invention has the following characteristics:

- the gangsaw is equipped with reciprocating movement using a connecting rod and crank system with a flywheel;
- the frame is driven by an oscillating motion which causes the blade to describe straight tangent lines in its reciprocating motion which are tangent to an approximately arc-shaped curved line.
- the oscillating movement of the frame is not synchronous with the reciprocating movement of the blades, with the result that the contact area between the blade and the workpiece moves along the blade and the height of the workpiece in a way which is not synchronous with the vertical reciprocating motion; the inversion moment of the reciprocating motion consequently moves continuously to different horizontal positions along the blade and different vertical positions on the block.

The term "block-cutting gangsaw" as used herein is intended to concisely describe a block-cutting machine using a blade-holding frame with reciprocating movement.

The term "gangsaw" or "blade-holding frame" defines the assembly constituted by the blades and the structure which supports and pre-loads them.

The term "reciprocating motion of the frame" means the motion imparted to the frame, causing it to travel along its guides.

The term "oscillating motion of the frame" means a combined traverse and rotation motion which modifies the position and orientation of the frame in relation to the workpiece so that the contact area moves along an arc with an approximately circular, convex shape.

The term "block" is used to mean the workpiece, which generally has a parallelepiped shape and is made of granite or other material.

This invention is further described below in a preferred form of practical embodiment, by way of example but not of limitation, with reference to the annexed drawings, wherein:

FIG. 1 schematically illustrates a frame driven by reciprocal motion on fixed guides.

FIG. 2 schematically illustrates a side view of the mechanism which produces the oscillating movement of the frame.

FIG. 3 schematically illustrates a view from above of the mechanism which produces the oscillating movement of the frame, with some parts shown in a different position from FIG. 2 for convenience of drawing.

Figure 1:
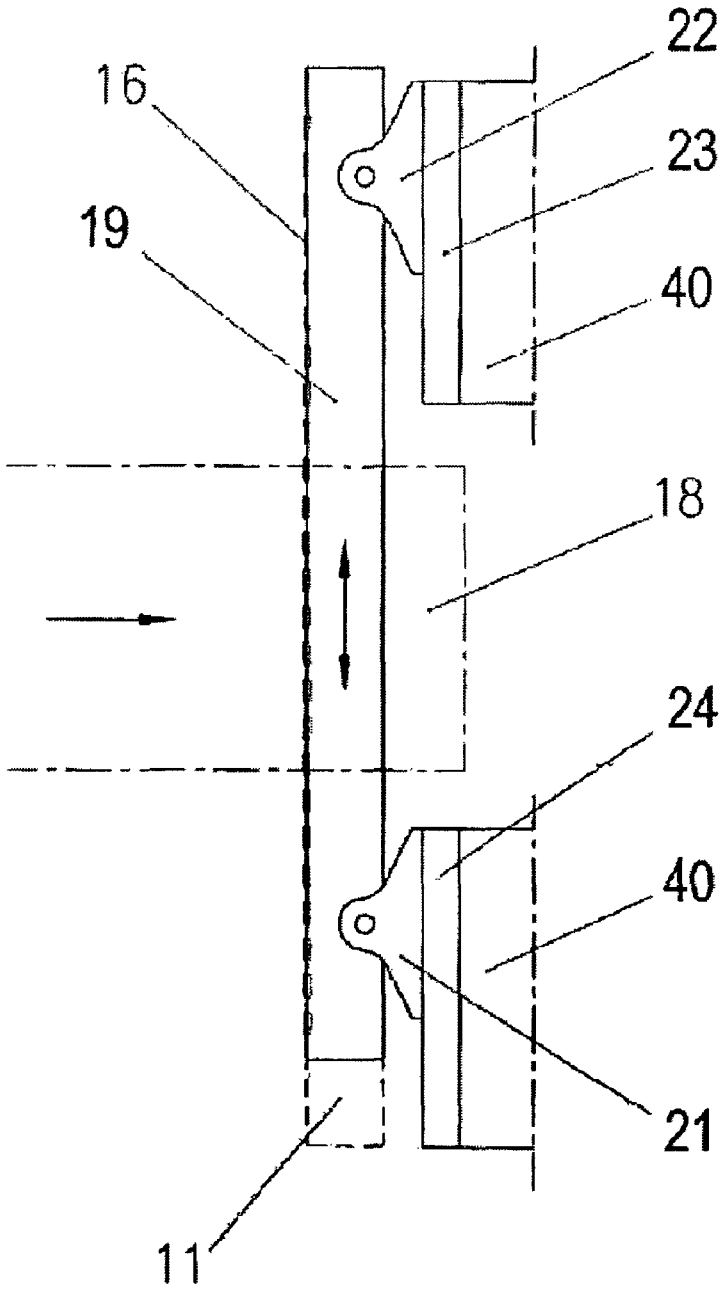

FIG. 1 shows the reciprocating motion of frame 19 integral with blades 20 (FIG. 3), which are shown in the uppermost position; during vertical oscillation said blades move between this position and the lowermost position indicated as 11. This reciprocating motion is usually obtained with a connecting rod and crank mechanism. The blade-holding frame integral with blades 20 describes a linear movement directed by four linear guides, two of which are shown, namely the guides located on one side, numbered 23 and 24, which are integral with the fixed part of the structure of the machine or with oscillating frame 40 described below. The two counterguides 22 and 21 run on one side of the said guides, and there are two more on the other side. The figure only shows one side of the frame; however, it should be remembered that there are also two other guides on the opposite side, with the two corresponding counterguides. During the reciprocal motion of the blades, block 18 advances in the direction indicated by the arrow.

Frame 19 and the blades integral with it, to which diamond segments 16 are attached, moves with a practically linear motion as the four guides are vertical and fixed to the structure.

Figure 2:
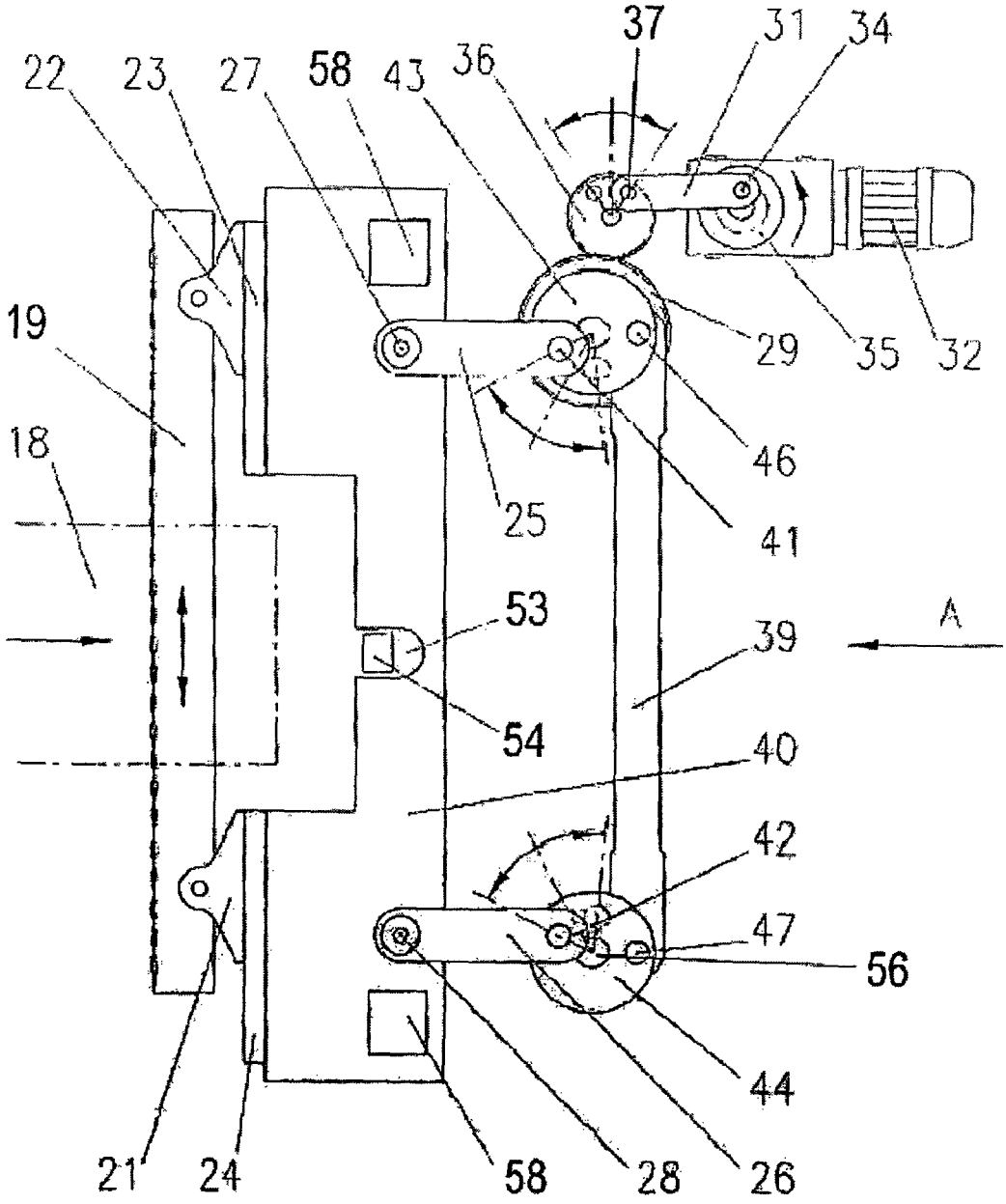
Figure 3:
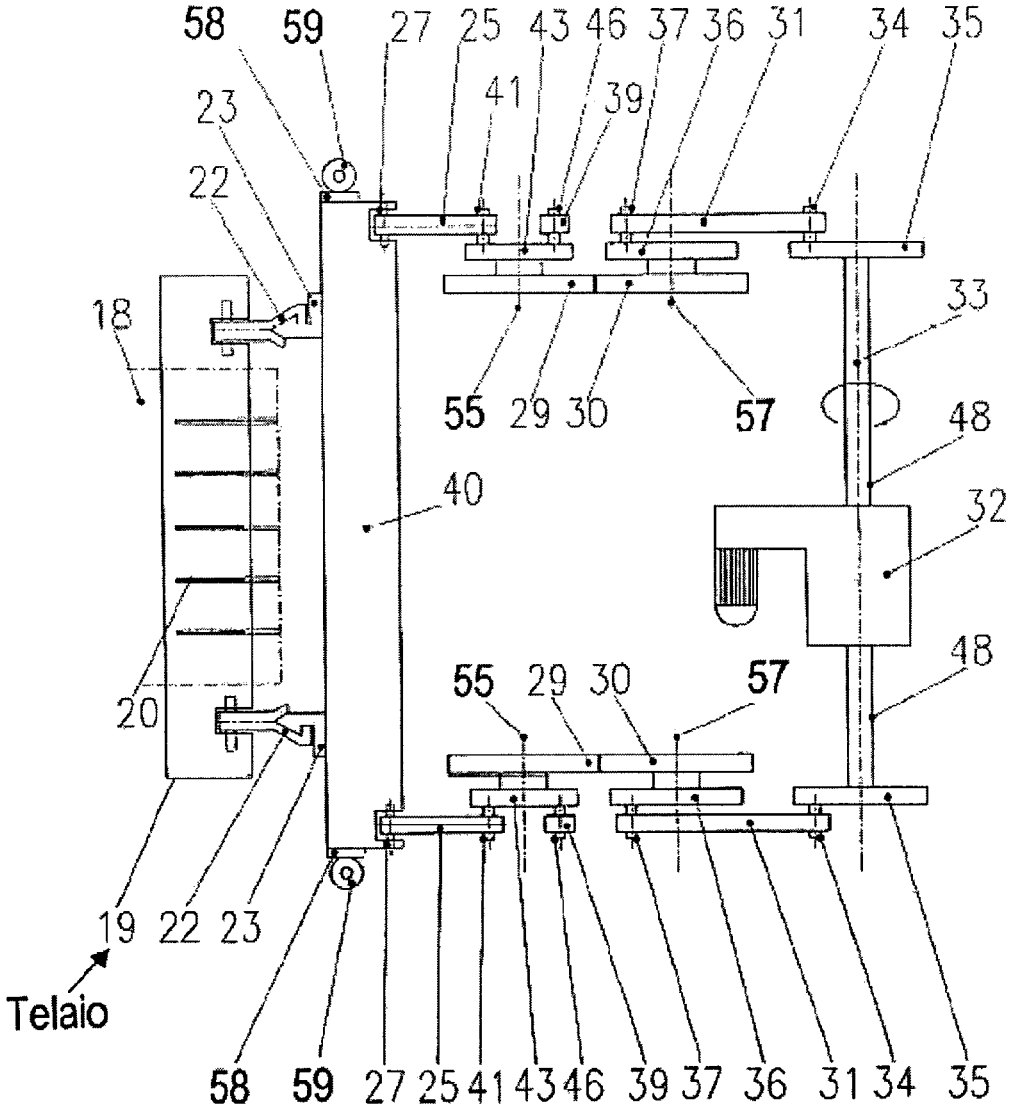

FIGS. 2 and 3 show how the oscillating movement of the frame is obtained. Frame 19, which is integral with blades 20, is guided by the four counterguides (two upper counterguides 22 and two lower counterguides 21) which are coupled to the four guides (two upper guides 23 and two lower guides 24). All four guides are integral with oscillating frame 40, which in turn is driven horizontally by two upper connecting rods 25 and two lower connecting rods 26 via the two corresponding upper pins 27 and two corresponding lower pins 28, while it is constrained not to traverse vertically by the presence on both sides of two cavities 53 which engage with two discs 54, and constrained not to traverse laterally by the presence of four fixed wheels 59 (FIG. 3) which rest on four platforms 58 in the oscillating frame.

The oscillating frame is therefore driven in the longitudinal direction by the two connecting rods 25 at the top, via pins 27, and the two connecting rods 26 at the bottom, via the other two pins 28, which perform the same movement in pairs. The two upper connecting rods engage with pins 41, while the two lower connecting rods engage with integral pins 42, and rotate with the two upper discs 43 and two lower discs 44 respectively, which are free to rotate around coinciding upper axes 55 and lower axes 56 respectively. It should be noted that upper pins 41 move in a different quadrant from lower pins 42, and that their rotations are constrained by the presence of the two synchronous rods 39 which are connected to discs 43 and 44 via the two upper pins 46 and two lower pins 47. Upper discs 43, which are free to rotate around axis 45, are coaxial with two driven gears 29 that engage with drive gears 30 (FIG. 3), integral with discs 36, which are free to rotate around axes 57. Discs 36 are fitted with pins 37; connecting rods 31 are constrained at one end to pins 37 and at the other end to pins 34 connected to discs 35, which are free to rotate around axis 33. The two discs 35 (right and left) are constrained to one another by shaft 48, which is caused to rotate by gear motor 32.

As the eccentricity of pins 34 on discs 35 is much less than the eccentricity of pins 37 on discs 36, pins 34 perform a complete, continuous rotation, whereas pins 37 perform an angular oscillation which in any event is of a smaller amplitude than 180 degrees. The amplitude of said angular oscillation of the two right and left discs 36 is reduced by the reduction ratio given by the ratio between the numbers of teeth of wheels 29 in relation to wheels 30, obtaining an angular oscillation of pins 41, integral with discs 43, which have the desired amplitude. Pins 42 in the lower part which are integral with discs 44 obviously perform the same angular oscillation, in the opposite direction, due to the effect of synchronous rods 39.

Figure 4:
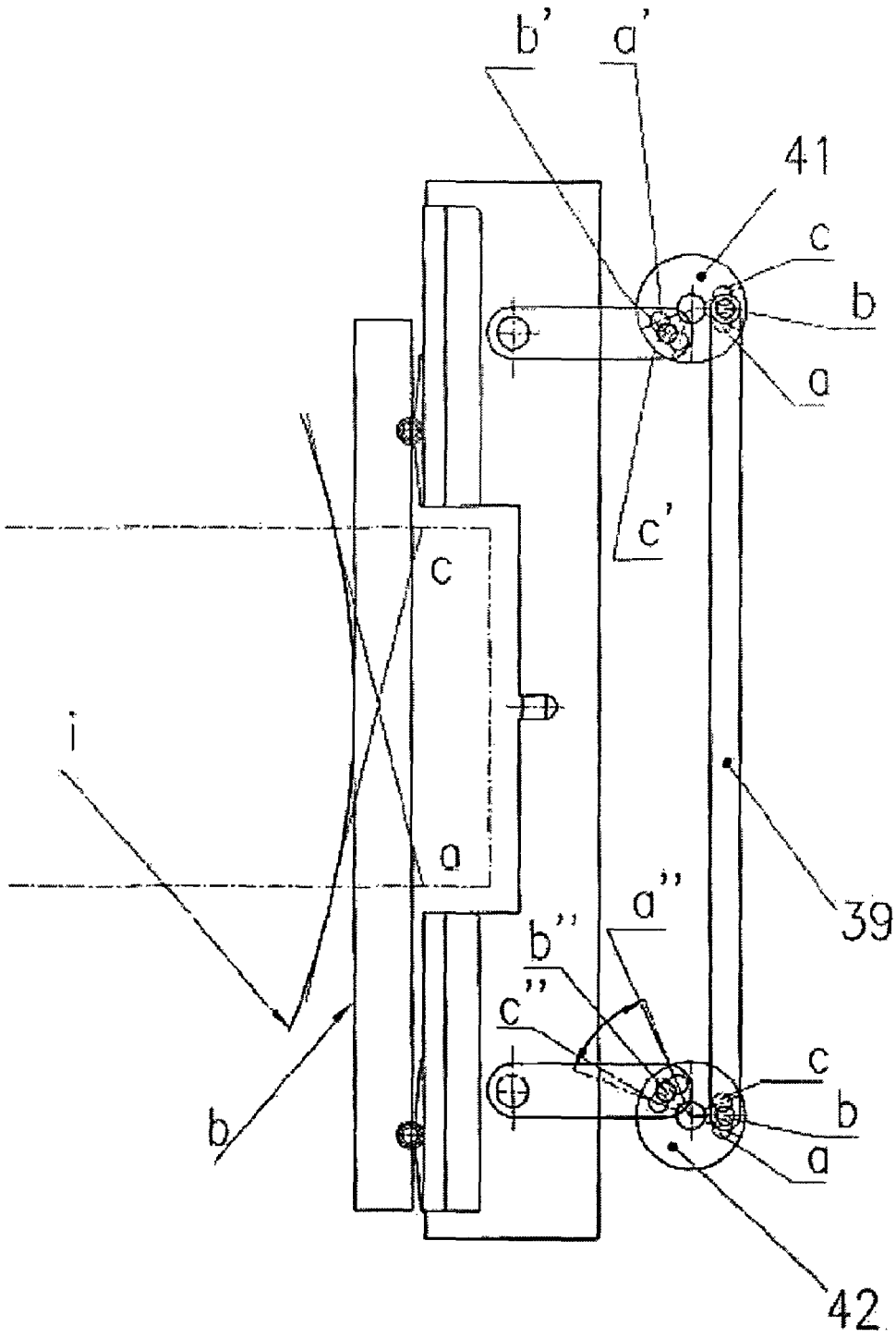
FIG. 4 shows how the oscillating movement of the frame is generated.

FIG. 4 shows how the approximately circular envelope movement of the blades is achieved as the effect of the oscillating motion of the frame.

Said oscillating motion of the frame is produced by the angular oscillation of the two pins of connecting rods 25 and 26, which cause the oscillating frame to oscillate. The mean position b' assumed by the two upper pins 41 in relation to upper disc 43 is opposite to mean position b" assumed by the two lower pins 42 in relation to the corresponding disc 44. Consequently, when the discs rotate in one direction, e.g. clockwise, upper pins 41 move to position a', which causes the frame to advance towards the block, while lower pins 42 move to position a", causing it to retract. However, the amplitudes are different, as they are on the circumference, and the horizontal movement imparted to the frame is proportional to the cosine of the angle:

$$Xi = R\cos(\alpha o + \alpha d)$$

$$Xs = R\cos(\alpha o - \alpha d)$$

where $\alpha o$ is the mean angle and $\alpha d$ is the rotational traverse, R is the eccentricity of the pin, and Xi and Xs are the lower and upper movements respectively.

Similarly, when the two discs rotate anticlockwise, the upper pin moves to position c' and causes the frame to retract, whereas the lower pin moves to position c" which causes it to advance.

The result of these movements is that the angular oscillation imparted to the frame moves the action line of the blades so that said line is tangent to a curve whose shape is almost an arc.

The radius of curvature is a function of the geometrical factors present, such as the mean angle $\alpha o$ of the disc pins, the amplitude of the angular oscillation around said mean value, and the length of the connecting rods, but can easily be predefined, and possibly modified, by simulating the movement with CAD.

Figure 5:
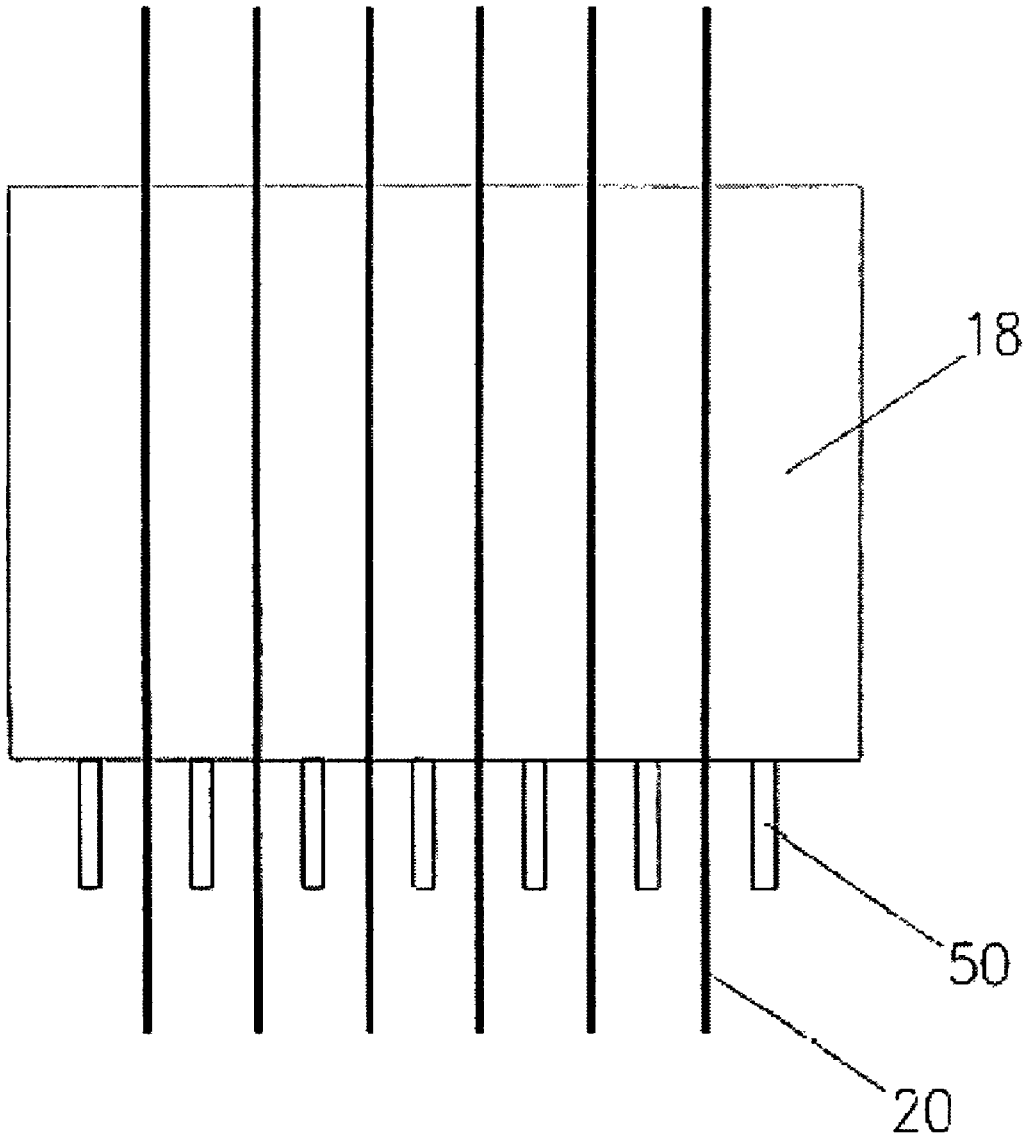
FIG. 5 shows the block support and advance system, illustrated in the direction of arrow A in FIG. 2.

FIG. 5 shows a front view of the machine, illustrating the system which causes block 18 to advance with a block-holding frame constituted by a number of blades 50 which alternate with cutting blades 20. Block-holding blades 50 rigidly support the block along its entire length, and also impart the advance movement to it.

The aim of providing a gangsaw for cutting granite and marble which allows the pressure of the blade in contact with the material to be increased is achieved by the innovation forming the subject of the invention, which reduces the length of the contact area between the blade and the block.

The aim of providing a frame movement system which causes the contact area to describe a curved trajectory in which the blade moves in a way not synchronous with the reciprocal motion of the frame is also achieved.

A preferred embodiment of this invention has been illustrated and described, but working variations could be made in practice, while still remaining within the ambit of protection provided by this industrial invention patent.

The invention claimed is:

1. A block-cutting gangsaw with vertical frame for cutting a block of granite or other hard material, comprising:

a blade-holding frame, the frame adapted to undergo reciprocating and oscillating motion so as to determine a curved cutting trajectory on the block, wherein the blade-holding frame is further adapted to undergo reciprocating movement on an independent oscillating frame which imparts the oscillating motion, so that each blade of the blade-holding frame is always in contact with the block, wherein a contact area between the blade-holding frame and the block moves along a convex, curved trajectory, wherein the oscillating motion of the blade-holding frame is obtained by combining longitudinal traverses and rotations of the oscillating frame, and wherein the oscillating frame is prevented from traversing vertically by way of lateral engagement means configured to engage with complementary means fitted to a fixed structure of the block-cutting gangsaw and prevented from traversing laterally by further complementary sliding lateral engagement means.

2. A block-cutting gangsaw with vertical frame for cutting a block of granite or other hard material, comprising:

a blade-holding frame, the frame adapted to undergo reciprocating and oscillating motion so as to determine a curved cutting trajectory on the block, wherein the blade-holding frame is further adapted to undergo reciprocating movement on an independent oscillating frame which imparts the oscillating motion, so that each blade of the blade-holding frame is always in contact with the block, wherein a contact area between the blade-holding frame and the block moves along a convex, curved trajectory, and wherein said blade-holding frame is guided, in its reciprocating motion, by four counterguides integral with the blade-holding frame, the four counterguides comprising two upper guides and two lower guides which are coupled to four corresponding guides, including two upper corresponding guides and two lower corresponding guides, integral with the oscillating frame.

3. A block-cutting gangsaw with vertical frame for cutting a block of granite or other hard material, comprising:

a blade-holding frame, the frame adapted to undergo reciprocating and oscillating motion so as to determine a curved cutting trajectory on the block, wherein the blade-holding frame is further adapted to undergo reciprocating movement on an independent oscillating frame which imparts the oscillating motion, so that each blade of the blade-holding frame is always in contact with the block, wherein a contact area between the blade-holding frame and the block moves along a convex, curved trajectory, and wherein the oscillating motion of said oscillating frame supporting the blade-holding frame is obtained with four connecting rod and crank arrangements, comprising two upper arrangements and two lower arrangements, all driven by a single motorized drive system.

4. The block-cutting gangsaw of claim 3, wherein upper connecting rods of the upper arrangements comprise upper drive pins associated with corresponding upper discs and lower connecting rods of the lower arrangements comprise lower drive pins associated with corresponding lower discs, the upper drive pins having a mean angle on the upper discs which is opposite to a mean angle of the lower drive pins on the lower discs.

5. The block-cutting gangsaw of claim 4, wherein said upper discs and said lower discs are connected via corresponding synchronous rods, hinged to upper pins and lower pins, respectively.

6. A block-cutting gangsaw with vertical frame for cutting a block of granite or other hard material, comprising:

a blade-holding frame, the frame adapted to undergo reciprocating and oscillating motion so as to determine a curved cutting trajectory on the block, wherein the blade-holding frame is further adapted to undergo reciprocating movement on an independent oscillating frame which imparts the oscillating motion, so that each blade of the blade-holding frame is always in contact with the block, wherein a contact area between the blade-holding frame and the block moves along a convex, curved trajectory, and wherein the oscillating motion of the oscillating frame supporting the blade-holding frame is not synchronous with the reciprocating motion of said blade-holding frame.

7. The block-cutting gangsaw of claim 3, further comprising an axle located between the single motorized drive system and the four connecting rod and crank arrangements, to reduce or multiply an oscillation angle of connecting rods of the upper and lower arrangements.

8. A block-cutting gangsaw with vertical frame for cutting a block of granite or other hard material, comprising:

a blade-holding frame, the frame adapted to undergo reciprocating and oscillating motion so as to determine a curved cutting trajectory on the block, wherein the blade-holding frame is further adapted to undergo reciprocating movement on an independent oscillating frame which imparts the oscillating motion, so that each blade of the blade-holding frame is always in contact with the block, wherein a contact area between the blade-holding frame and the block moves along a convex, curved trajectory, and wherein the block is supported by a block support system, the block support system comprising a frame fitted with blades.

* * * * *